United States Patent [19]

Olcott et al.

[11] 4,117,855

[45] Oct. 3, 1978

[54] WASHING MACHINE FOR INDUSTRIAL PARTS

[76] Inventors: Richard J. Olcott, 329 Grand St., Allegan, Mich. 49010; Ronald H. Cross, 7622 Sprinkle Rd., Kalamazoo, Mich. 49001

[21] Appl. No.: 795,809

[22] Filed: May 11, 1977

[51] Int. Cl.[2] ..... B08B 3/02

[52] U.S. Cl. ..... 134/141; 134/143; 134/155; 134/175; 134/176; 134/200

[58] Field of Search ..... 134/138–141, 134/143, 148, 153, 155, 175–179, 200

[56] References Cited

U.S. PATENT DOCUMENTS

| | | | |
|---|---|---|---|
| 1,502,131 | 7/1924 | Vaudrevil | 134/200 X |
| 2,608,981 | 9/1952 | Jackson | 134/176 X |
| 2,704,082 | 3/1955 | Jackson | 134/200 X |
| 2,826,208 | 3/1958 | Boffa | 134/141 |
| 3,514,329 | 5/1970 | Hull | 134/177 X |
| 3,760,823 | 9/1973 | Ferguson | 134/141 |
| 3,949,772 | 4/1976 | Hartmann | 134/200 X |

FOREIGN PATENT DOCUMENTS

| | | | |
|---|---|---|---|
| 645,941 | 9/1962 | Italy | 134/143 |
| 2,431,895 | 1/1976 | Fed. Rep. of Germany | 134/140 |

*Primary Examiner*—Robert L. Bleutge
*Attorney, Agent, or Firm*—Austin A. Webb

[57] ABSTRACT

A square base with upright side walls and a flat top wall defining a large circular opening has an upstanding ring spaced concentrically around the opening. A cylindrical hood open at the bottom fits within the ring and is pivotally connected to the top of the base. A pair of fluid pressure operated cylinders with piston rods are connected to opposite sides of the base and the hood to swing the hood about its pivot to open position above the base. A work supporting grid is supported within the base below the ring. A tank is connected to one side wall of the base, and an inclined collector plate located in the base below the grid drains to a hole opening to the top of the tank. Liquid delivery couplings connected to the top of the hood and the top of the collector plate centrally thereof with fixed cylindrical outlet housings projecting toward the inside of the hood have receiving connections on their ends located outwardly of the hood and plate. Receiving rings are swivelly mounted around the cylindrical outlet housings with liquid passages therebetween. Spray pipes are connected to the receiving rings and project radially therefrom, with jet openings in the pipes directed inwardly of the hood and plate and at angles to planes passed through the pipes and the axes of the rings to rotate the pipes and receiving rings by reaction force of liquid spraying into the hood from the pipes. A pump and driving motor are supported on one side of the base with an inlet to the pump extending downwardly into the tank. Feed hoses connect the outlet of the pump to the receiving connections of the fluid delivery couplings.

10 Claims, 6 Drawing Figures

WASHING MACHINE FOR INDUSTRIAL PARTS

OUTLINE OF INVENTION

In the manufacture or repair of various machines or machine parts it is common for the articles, particularly metal articles, to require cleaning to remove dirt, chips, oil and other foreign material from the articles prior to assembly or further operation on the articles. This has been accomplished in the past by subjecting the articles to a washing operation with a suitable cleansing liquid, commonly a caustic liquid. Small articles are collected in an open mesh basket and the basket, or individual larger articles, are placed in a washing machine by placing them on a door which opens outwardly from an enclosure. The articles are then slid onto a grid in the enclosure and the door is closed. The grid then rotates within the enclosure while spray heads located in fixed positions above and below the work then subject the work to repeated jets of the appropriate cleaning liquid.

The present invention provides essentially the same function with a less expensive washing machine which may be loaded and unloaded more expeditiously than prior machines. Specifically, the enclosure of the invention is opened by swinging or moving an inverted housing or drum away from a grid supported on a hollow base so that the work may be deposited directly on the grid, either by hand or by forklift trucks in the case of pallet loads of work parts. Rotatable spray heads located both in the drum and in the base below the grid are then rotated by reaction force of the spray liquid delivered therethrough. By substituting a vertically movable enclosure for a fixed enclosure with a door, the expense of sealing the door to the wall of the enclosure is avoided. Also, the expense of providing a rotating grid and a door and hinge with sufficient strength to support the work load is avoided; as is the expense or bother of moving the load to and from the enclosure from an open door with each washing cycle.

It is a feature of the washing machine of the present invention that the upper and lower liquid delivery couplings which deliver to the rotation spray heads may be identical, and that they have loose connections with the rotating receiving rings since the connections are at all times located within the enclosure. This permits the washing liquid to act as a lubricant between the rotating receiving rings and the cylindrical outlets of the liquid couplings and permits the rings and the delivery couplings to be made with wide and relatively inexpensive tolerances. The rotating receiving rings are freely supported on thrust bearings which are also lubricated by the liquid flowing through and around the rings.

DESCRIPTION

The drawings, of which there are three sheets, illustrate a preferred form and one alternate form of the washing machine of the invention.

Figure 1:
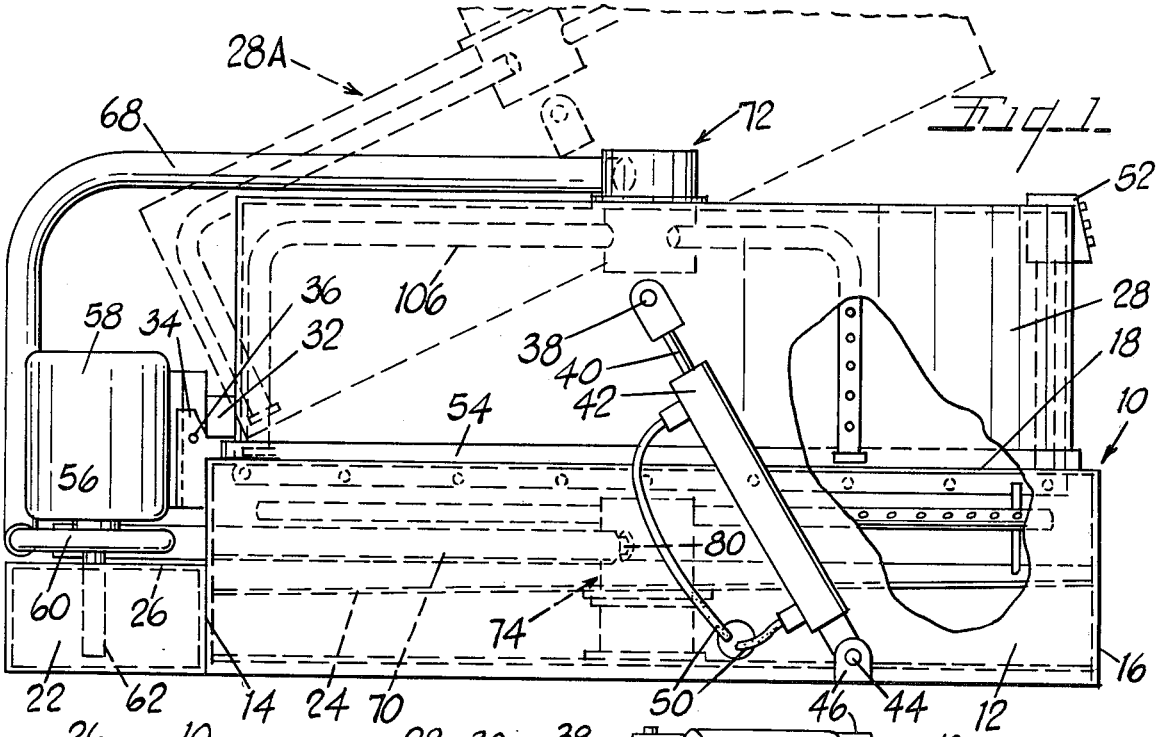
FIG. 1 is a side elevational view of a preferred form of the washing machine, with exterior parts broken away to show internal parts.
Figure 2:
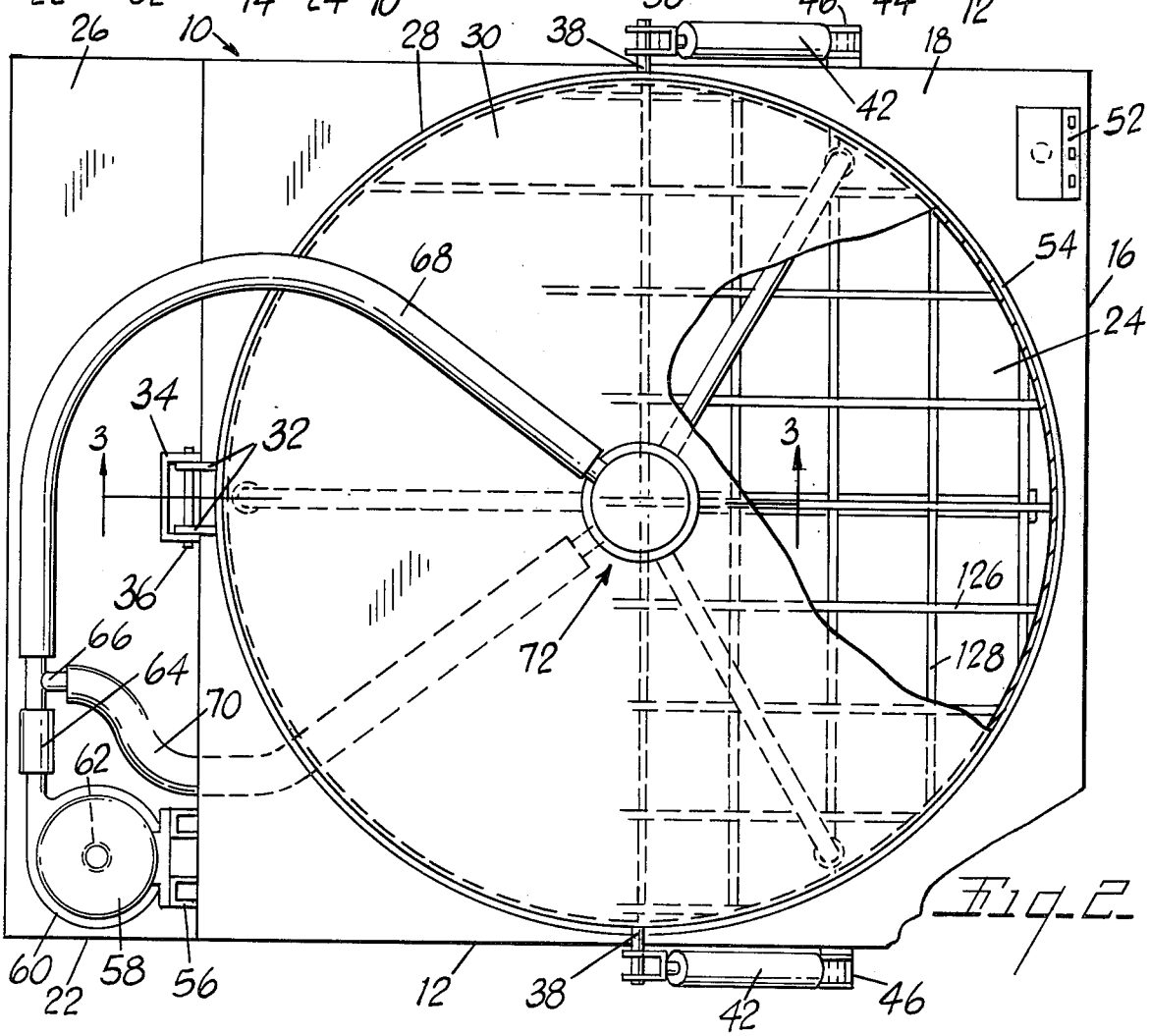
FIG. 2 is a top plan view of the washing machine in FIG. 1, also with parts broken away.

The preferred form of the washing machine shown in FIGS. 1–4 includes a square base indicated generally by the numeral 10 with vertical side walls 12, a rear wall 14 and a front wall 16 supporting a top wall 18 with a large circular hole or opening 20 therein. A rectangular tank 22 is connected to the rear wall 14 with the lower part of the rear wall common to the base and the tank. A collector plat 24 which is inclined in two directions, as will be described in greater detail presently, is secured to the side walls 12 and front and rear walls 16 and 14 along lines mid-way of the height of the walls and below the top wall 26 of the tank 22.

An inverted cylindrical hood 28 has a top wall 30 and hinge ears 32 secured to the rear of the cylinder. A channel 34 secured to and projecting above the rear wall 14 supports a hinge pin 36 passing through the ears 32. The hood is thus hingedly connected to the base and is swingable to an inclined open position indicated by the dotted lines at 28A. Lift pins 38 project from the opposite sides of the hood and engage the piston rods 40 of fluid pressure actuated cylinders 42. The lower ends of the cylinders 42 are pivotally connected by pins 44 to yokes or channel brackets 46 secured to the side walls 12 of the base. Fluid under pressure for actuating the piston rods 40 is supplied from a source (not illustrated) through hoses 50, under the control of switch mechanism indicated conventionally at 52. An upstanding ring 54 is secured to the top of the top wall 18 in spaced relation to the hole 20 to leave a lip on which the bottom of the hood 28 rests when closed.

Channels 56 secured to the rear wall 14 of the base project vertically above the top wall 18 and form a support for a motor 58 in vertical position over the top wall 26 of the tank. A centrifugal pump 60 driven by the motor has an inlet or suction line 62 projecting downwardly to near the bottom of the tank. An outlet hose 64 connects to a Tee 66 which divides the output of the pump between an upper feed hose 68 and a lower feed hose 70. The upper hose connects to an upper delivery coupling on the top of the hood and indicated generally at 72, while the lower hose connects to a lower delivery coupling generally indicated at 74 and supported by the collector plate 24 within the base 10.

The delivery couplings 72 and 74 are of simimlar construction, the upper coupling being inverted relative to the lower coupling. In each coupling a center cylindrical body 76 has an external mounting flange 78 which is attached to the outer side of the walls enclosing the washing chamber. Coupling 72 is mounted on the top wall 30 of the hood while coupling 74 is mounted on the collector plate 24. Each coupling has an inlet neck 80 and these are connected respectively to the hoses 68 and 70. Inwardly of the mounting flanges 78 the couplings have internal chambers 82 with radial outlet passages 84. A closure plate 86 is secured over the end of the chamber 82 by screws 88, and a gasket and bearing plate 90 is secured between the end of the body of the coupling and the plate 86. Freely rotatable about the cylindrical inner portion and the radial outlet passage 84 is a receiving ring 94 having an internal groove 96 communicating with the passage 84. The ring is rotatable between the gasket 90 and an opposite gasket and thrust plate 98 secured against the inner side of the mounting flange 78 by the same screws 100 which secure the coupling to the hood 28 or the bottom plate 24 in the base.

The receiving ring 94 on the upper coupling has three equi-angularly spaced ports 102 which receive and support three angular spray manifolds 104 having radially extending arms 106 with downwardly bent outer arms 108 on their outer ends. The ring 94 on the lower coupling has two opposed ports 110 which receive and support the ends of two radially extending spray manifolds 112. All of the manifolds have a series of passages 114 which define jet or spray nozzles directed inwardly of the washing chamber. The nozzle ports 114 are also inclined relative to vertical planes through the manifolds so that the reaction force of the jets rotates the manifolds.

It is pointed out that the rings 94 have a relatively loose rotational fit around the cylindrical inner ends of the couplings 72 and 74 and between the bearing and gasket members 90 and 98. Washing liquid leaking past these loose fits lubricates the bearing surfaces of the rings 94 and is allowed to leak or spray into the washing chamber.

Attention is now directed to the bottom plate 24 in the base 10. The plate is inclined upwardly from rear plate 14 to front plate 16 of the base, and is also angled upwardly at each side as at 116 in FIG. 3 so as to form a trough shaped bottom which inclines to a drain opening 118 in the rear plate which delivers to the tank 22.

Figure 3:
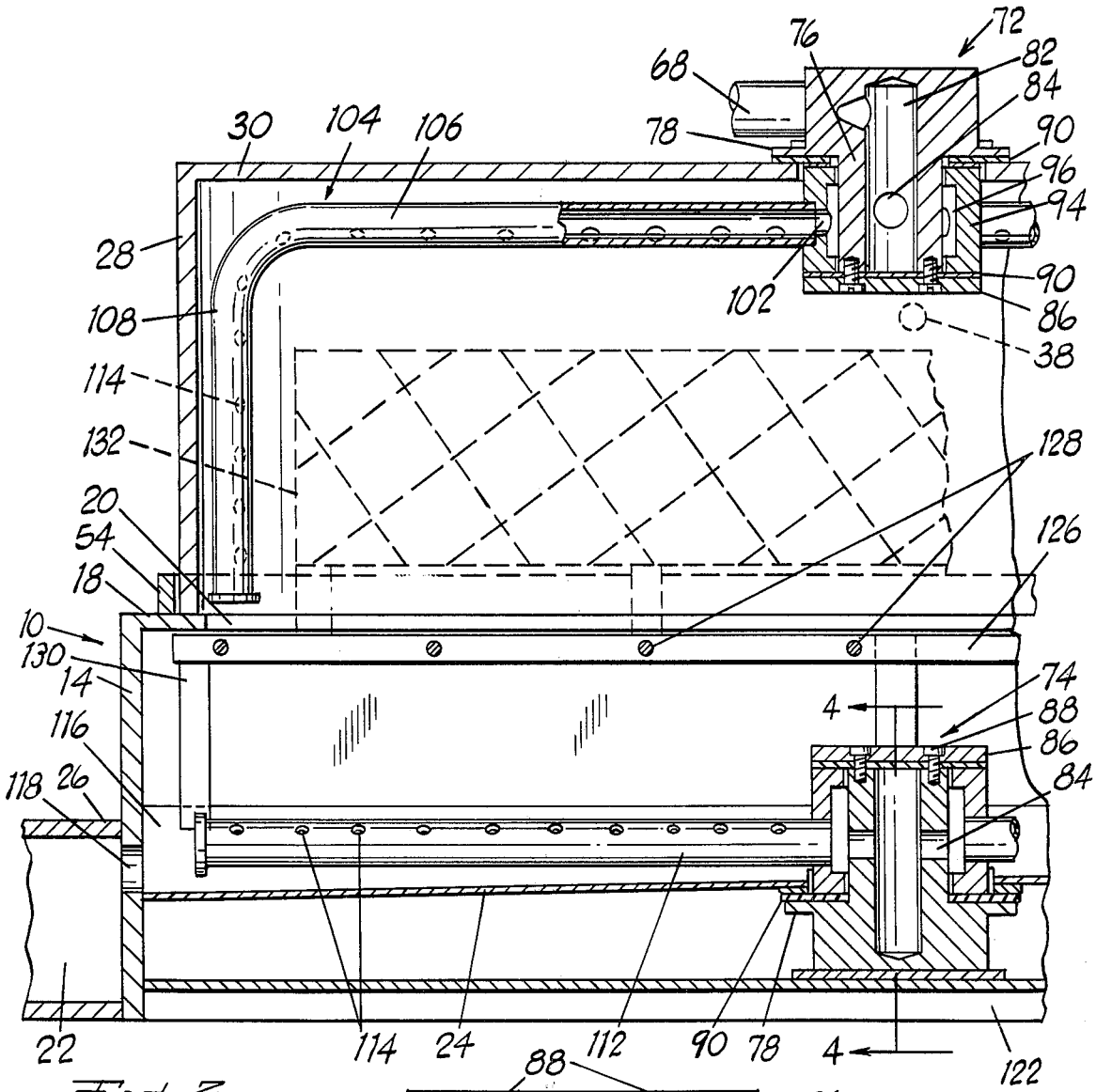
FIG. 3 is a fragmentary vertical cross sectional view in enlarged scale taken along the plane of the line 3—3 in FIG. 2.
Figure 4:
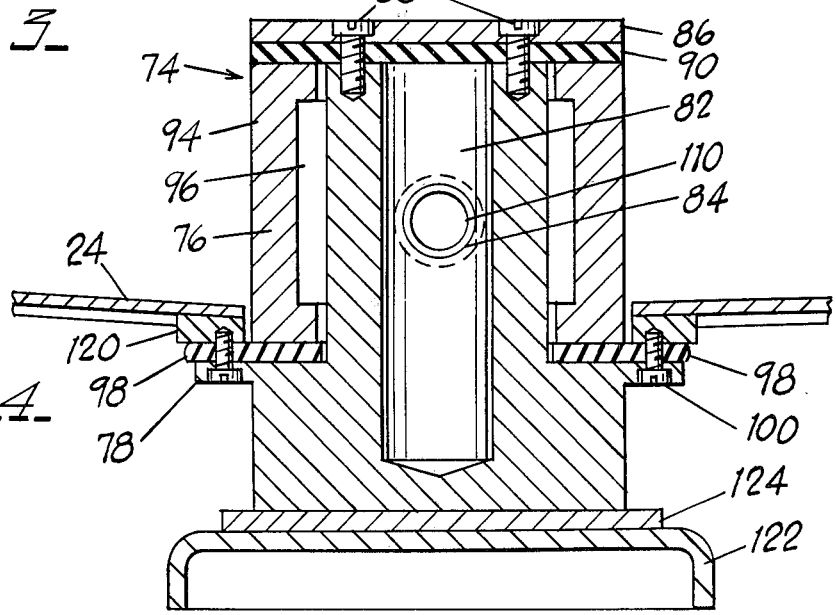
FIG. 4 is a further enlarged vertical cross sectional view taken along the plane of the line 4—4 in FIG. 3.

Also as shown in FIGS. 3 and 4, in order to provide a flat clamping surface for the exterior end of the lower coupling 74, a mounting ring 120 is welded to the bottom collector plate 24. The top of the ring is shaped to conform to the lateral incline of the sides of the collector plate, and also to the longitudinal inclination of the plate to the drain opening 118 to the tank. The coupling 74 is held in essentially vertical position by the screws 100 which hold it to the mounting ring.

In order to steady the lower coupling 74, a downwardly opening channel shaped brace bar 122 is connected between the lower edges of the rear and front plates 14 and 16 of the base. A pad or shim 124 supports the coupling 74 on this brace.

A stationary grid composed of longitudinally extending spaced rails 126 and crossing rods 128 is supported under the circular opening 20 in the top wall of the base and over the rotating spray arms 112 as by legs 130. This grid receives and supports the work to be washed, either directly or in a perforate pallet basket indicated by the dotted lines at 132 in FIG. 3.

Figure 5:
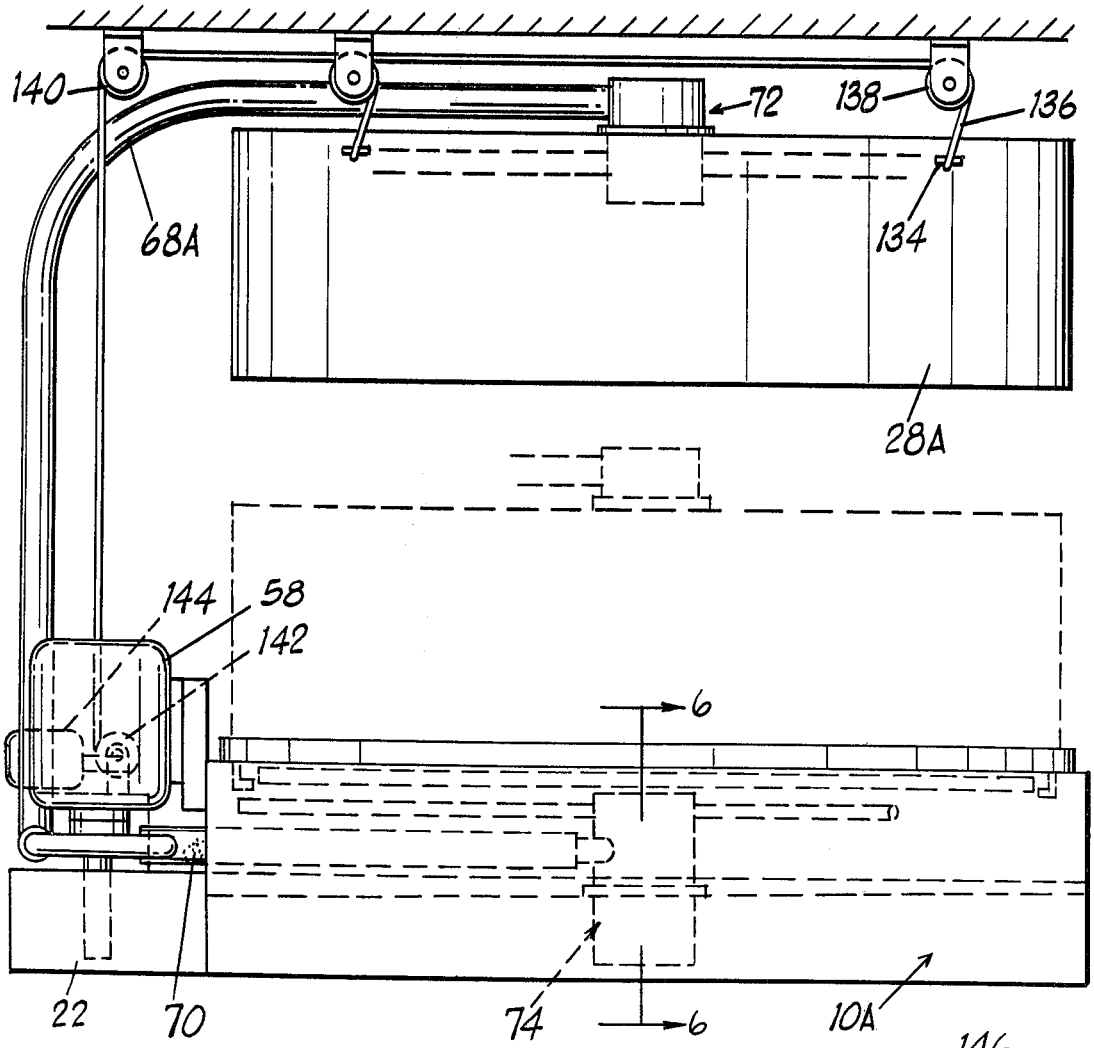
FIG. 5 is a side elevational view of a modified form of the machine shown in FIGS. 1–4.
Figure 6:
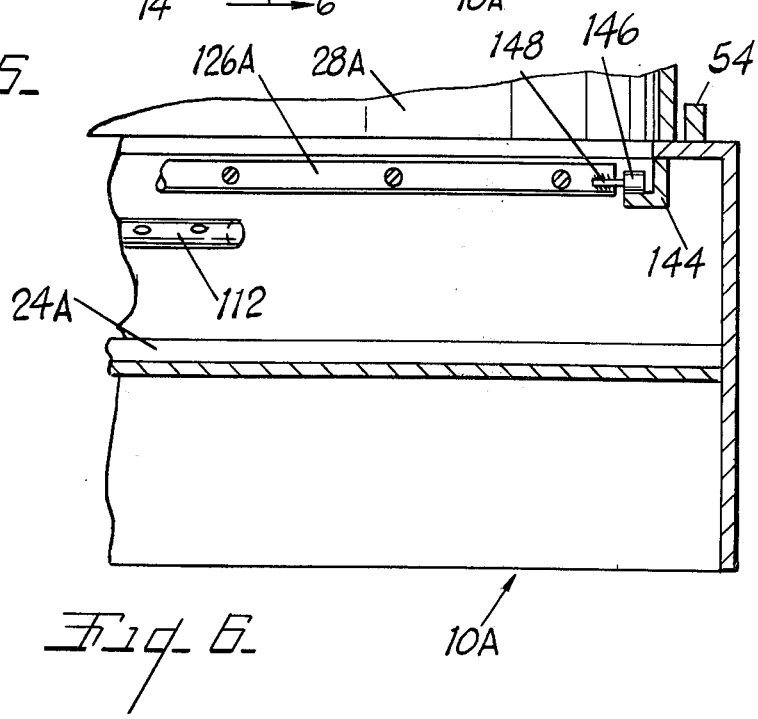
FIG 6 is an enlarged, fragmentary vertical cross sectional view taken along the plane of the line 6—6 in FIG. 5.

The modified form of the washing machine shown in FIGS. 5 and 6 has essentially the same base 10 and hood 28 as the first form of the machine described above. The tank 22, pump 60 and motor 58 are also the same as are the coupling members 72 and 74 and the spray manifolds 104 and 112. The modification lies in the means for opening the washing chamber for loading and unloading, and in the work supporting grid.

The modified hood 28A has ears 134 to which suspension cables 136 are attached and extended to pulley 138 on an overhead support. From the pulleys 138 the cables are directed over guide pulleys 140 and down to the drum 142 of a suitable winch or winding device mounted on the top of the tank 22. A motor for operating the drum is indicated at 144.

The base 10A has the same upstanding ring 54 on the top for receiving the hood 28A. However, the grid for supporting the work is made manually rotatable by adding a support ring 144 of angle shaped cross section around the central opening 20 in the top plate of the base. Suitable rollers 146 are mounted on the grid as by stub axles 148 welded to the ends of grid rails 126A. The rotatable grid permits large articles or basket pallets to be removed or loaded from any three sides of the base as these are clear whenever the hood is raised. Also, the work may be loaded from one side, then manually rotated for removal from another side.

The bottom collector plate 24A may be a flat planar plate inclined in one plane only.

What is claimed to be new and what is desired to be secured and protected by Letters Patent is defined by the following claims:

1. An industrial washing machine for machines and machine parts comprising:

an upright base having a top wall defining a central opening, a tank associated with said base and located below the top thereof, a collector plate mounted within said base intermediate of the height thereof below said central opening and inclined toward said tank, a work supporting grid supported in said base adjacent the plane of said central opening, a downwardly opening concave hood movably supported on said top wall and covering said central opening and having a top wall spaced above the top wall of the base, said hood and said base forming a washing chamber above said collector plate when said hood is losed on said base, power driven means connected to raise said hood to open position above said base and said grid, liquid delivery couplings mounted centrally of said collector plate and the top of said hood and projecting in sealed relation thereto into said washing chamber, receiving rings rotatably mounted on said delivery couplings interiorly of said washing chamber and arranged to receive liquid from said couplings, spray pipes connected to said receiving rings and rotatable therewith in radially extending position therefrom and in liquid communicating relation therewith, jet openings formed in said spray pipes directed inwardly of said washing chamber and at angles to planes through the axes of the rings to rotate the pipes and rings about said couplings, a pump and driving motor therefor arranged to draw liquid from the tank, conduits connected between the outlet of said pump and said liquid delivery couplings exteriorly of said washing chamber, the conduit connected to the delivery coupling on the hood being flexible, and means forming a drain connection from a low point on said collector plate to said tank.

2. A washing machine as defined in claim 1 in which said tank and said base have a common wall, and in which said drain connection is formed by an opening in the upper part of said common wall.

3. A washing machine as defined in claim 2 in which said collector plate has a central V-shaped bend inclined to said drain connection.

4. A washing machine as defined in claim 3 in which said hood is cylindrical in cross section.

5. A washing machine as defined in claim 4 in which the means for raising said hood to open position comprises fluid pressure operated cylinders having piston rods, means connecting said rods to one part of said chamber and said cylinders to the other part of the chamber, and hinge means pivotally connecting said base and said hood at one side thereof.

6. A washing machine as defined in claim 4 in which said means for raising said hood to open position comprises suspension cables connected to said hood and adapted to be trained over fixed pulleys to a winding means.

7. A washing machine as defined in claim 3 in which said pump and its driving motor are mounted on one side of said base over said tank.

8. A washing machine as defined in claim 1 in which the spray pipes connected to the receiving ring mounted within said hood have branches at their radially outer ends turned axially downwardly within the cylindrical side of the hood and in spaced clearing relation to the hood.

9. A washing machine as defined in claim 1 in which said top wall of said base has an upstanding flange thereon located around said central opening and radially outwardly from the opening, said upstanding flange being sized to receive the lower end of said hood when closed on the base.

10. An industrial washing machine for machines and machine parts comprising:

an upright base having a top wall defining a central opening, a tank having a common wall with a sidewall of said base and a top located below the top of the base, a collector plate mounted within said base and below said central opening, said plate having a V-shaped bend inclined toward said common wall, there being a drain hole in the wall from the bend to said tank, an annular support surface on said top wall of said base around said opening, a circular work supporting grid having radially extending rollers around its edge engaged with said annular support, a cylindrical hood having an open bottom engageable with said top wall around said opening and forming a washing chamber above said grid and said collector plate, liquid delivery couplings mounted centrally of said collector plate and the top wall of said hood and projecting into said washing chamber, receiving rings rotatably mounted around said couplings and arranged to receive liquid therefrom, spray pipes connected to said rings and rotatable therewith and arranged to receive liquid from the rings, said spray pipes having jet openings therein directed inwardly of said chamber, a pump arranged to draw liquid from said tank and deliver it through conduits to said delivery couplings, the conduit to the coupling on the top of said hood having a flexible portion, suspension cables connected to said hood around its periphery and adapted to be trained over fixed pulleys above the hood, and winding means including a drum and driving motor therefor mounted on top of said tank and adapted to raise and lower said hood by winding said cables.

* * * * *